US005428364A

United States Patent [19]

Lee et al.

[11] Patent Number: 5,428,364

[45] Date of Patent: Jun. 27, 1995

[54] WIDE BAND DIPOLE RADIATING ELEMENT WITH A SLOT LINE FEED HAVING A KLOPFENSTEIN IMPEDANCE TAPER

[75] Inventors: Jar J. Lee, Irvine; Stan W. Livingston, Fullerton, both of Calif.

[73] Assignee: Hughes Aircraft Company, Los Angeles, Calif.

[21] Appl. No.: 65,130

[22] Filed: May 20, 1993

[51] Int. Cl.[6] ..... H01Q 13/10

[52] U.S. Cl. ..... 343/767; 343/770; 343/795

[58] Field of Search ..... 343/767, 795, 820, 821, 343/822, 770, 768; H01Q 13/10

[56] References Cited

U.S. PATENT DOCUMENTS

| | | | |
|---|---|---|---|
| 4,425,549 | 1/1984 | Schwartz et al. | 333/239 |
| 4,573,056 | 2/1986 | Duôme et al. | 343/795 |
| 4,760,400 | 7/1988 | Lait | 343/830 |
| 4,782,346 | 11/1988 | Sharma | 343/795 |
| 4,905,013 | 2/1990 | Reindel | 343/795 |
| 5,021,799 | 6/1991 | Kobus et al. | 343/818 |

FOREIGN PATENT DOCUMENTS

| | | | |
|---|---|---|---|
| 8402038 | 5/1984 | WIPO | 343/795 |

*Primary Examiner*—Donald Hajec
*Assistant Examiner*—Hoanganh Le
*Attorney, Agent, or Firm*—W. K. Denson-Low

[57] ABSTRACT

A wideband radiating element including an input mechanism for receiving electromagnetic energy from a source and a balanced feeding mechanism extending from the input mechanism for transmitting the electromagnetic energy and for providing impedance matching over a range of frequencies. Finally, a dipole mechanism extending from the balanced feeding mechanism is provided for radiating the electromagnetic energy where the dipole mechanism has a shape to provide wide bandwidth impedance matching. In a preferred embodiment, an input mounting block is connected to the two opposing sides of a planar dielectric substrate. A balanced narrow conductor slot line extends from the input mounting block on both sides of the dielectric substrate to transmit the electromagnetic energy and to provide impedance matching over a frequency range of (0.5 to 18) GHz. The narrow conductor slot line is tapered to match the radiation resistance of a dipole element utilized to radiate the electromagnetic energy. The dipole element extends from the balanced narrow conductor slot line on both sides of the dielectric substrate with each wing having an expanded width for accommodating surface current of various distributions over the frequency range. The dipole element also includes an inner taper for radiating energy over the frequency range with the position of the dipole element relative to a ground plane being optimized to minimize radiation reflection.

4 Claims, 5 Drawing Sheets

FIG. 1
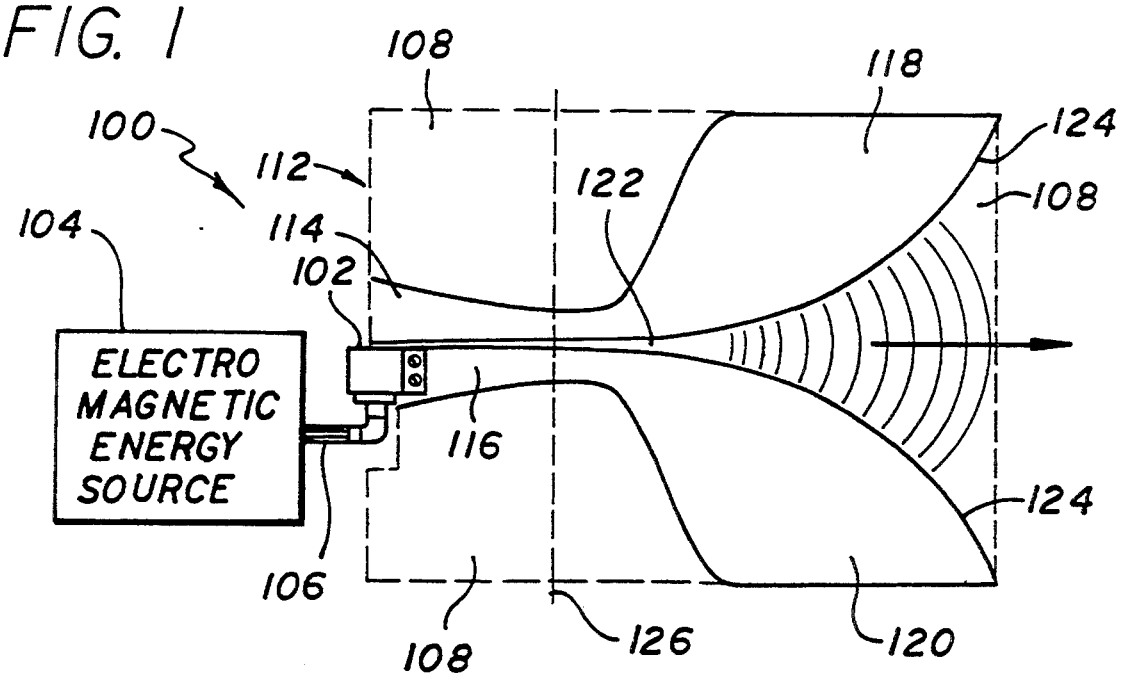
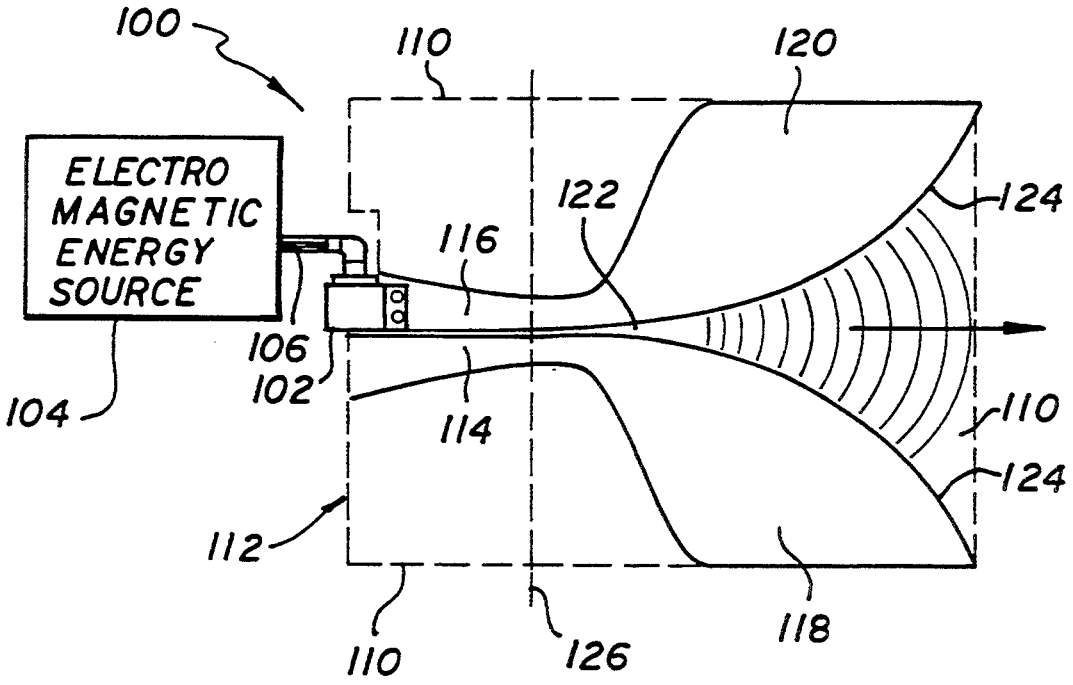
FIG. 2

WIDE BAND DIPOLE RADIATING ELEMENT WITH A SLOT LINE FEED HAVING A KLOPFENSTEIN IMPEDANCE TAPER

BACKGROUND OF THE INVENTION

1. Field of the Invention

The present invention relates to radar applications. More specifically, the present invention relates to methods and apparatus for a wideband radiating element for radar antenna applications.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

2. Description of the Related Art:

Phased array antenna systems include at least one element employed for radiating electromagnetic energy into the atmosphere. During the transmission phase, the electromagnetic energy is delivered from a source to an input mounting block via a coaxial cable. Positioned adjacent to the mounting block is a gap formed between a pair of large conductors connected to the leads of the coaxial cable. As the electromagnetic energy is switched across the gap, an electromagnetic wave is generated. The gap serves as a conduit to support the propagation of the energy wave along the large conductors for radiation to the atmosphere.

In order to maximize radiation efficiency and thus minimize energy reflection, the impedance of the input section, the gap and the conductors must be matched. Failure to satisfy this design criteria results in impedance mismatching over the desired frequency bandwidth. Under these conditions, the radiating element is limited to use in a narrower bandwidth. There is a need in the art to develop a radiating element for use with a wide bandwidth array supported by a fiber optic true-time-delay beamforming network. The array is intended to provide a range resolution of one nanosecond. To match this performance, the radiating elements must have compatible bandwidth characteristics. Unfortunately, radiating element designs known in the art are not capable of operating over such a wide bandwidth in an array environment.

An example of a radiating element of the prior art is the flared notch element. The flared notch element incorporates an input mounting block for connecting a coaxial cable to a pair of large flat conductors. One of the two coaxial conductors is connected to a first of the pair of large flat conductors while the other coaxial conductor is connected to the second of the large flat conductors. Microwaves are generated at the input of a slot line or notch located between the pair of large flat conductors. The slot line is narrow at the entry of the mounting block for the purpose of matching the 50Ω input impedance to the slot line impedance.

The generation and propagation of the microwaves in the slot line of the flared notch element has been discussed at length in the literature. However at certain frequencies, it is difficult to control the microwave radiation from the slot line. This problem occurs because the pair of large flat conductors and the coaxial mounting block do not form a balanced structure. The shunt capacitance existing between the first large conductor and the outer conductor of the coaxial cable destroys the symmetry of the surface current distribution on the radiating element. This is because the outer conductor of the coaxial cable has a larger surface area and is closer to the large flat conductors than the inner conductor of the coaxial cable. This situation will cause the current to flow on the outside surface of the coaxial cable as a return path thereby preventing the low frequency components from propagating down the slot line or notch.

To provide efficient microwave radiation, it is necessary to maintain control of the current over the bandwidth. In order to maintain control, the flow of current must be restricted to a narrow region. Specifically, the current is hard to control because the impedance of the large flat conductors does not remain fixed over a wide range of frequencies. The impedance of the large flat conductors does not remain fixed over a wide range of frequencies because the outer conductor of the coaxial cable has a larger surface area and is closer to the large flat conductors than the inner conductor of the coaxial cable. Thus, the current flow is unsymmetrical which impedes the propagation of certain frequency components of the microwaves. Since the impedance is difficult to control, matching the impedance between the input and the slot line is very difficult.

Unfortunately, this condition in the flared notch element of the prior art results in increased energy reflection and reduced radiating efficiency since the current flow along each radiating portion of the large flat conductors is not symmetrical. The large flat conductors function adequately only for narrow frequency bandwidths. However, for wider bandwidths, the flared notch element does not function adequately. Under these conditions, the impedance of the slot line varies due to the size of the outer coaxial conductor and the proximity to the large flat conductors. Thus, it is difficult to calculate and control the impedance of the slot line resulting in impedance mismatching over a wide bandwidth.

Finally, in the flared notch element, the low frequency components of the wave will be short-circuited by the shunt path through the large flat conductors of an adjacent radiating element in a radar array. This necessitates that the adjacent radiating elements in an array be separated by a distance which utilizes valuable space. Finally, the shunt paths to adjacent radiating elements in an array make it difficult to accurately predict the input impedance of the feed section. Hence, the difficulty in achieving a wideband match increases.

Thus, there is a need in the art for improvements in radiating elements for radar antenna systems which enable impedance matching along the slot line and energy propagation over a wide frequency bandwidth.

SUMMARY OF THE INVENTION

The need in the art is addressed by the wideband radiating element and method of the present invention. The invention includes an input mechanism for receiving electromagnetic energy from a source and a balanced feeding mechanism extending from the input mechanism for transmitting the electromagnetic energy and for providing impedance matching over a range of frequencies. Finally, a dipole mechanism extending from the balanced feeding mechanism is provided for radiating the electromagnetic energy where the dipole mechanism has a shape to provide wide bandwidth impedance matching.

In a preferred embodiment, an input mounting block is connected to the two opposing sides of a planar dielectric substrate. A balanced narrow conductor slot line extends from the input mounting block on both sides of the dielectric substrate to transmit the electromagnetic energy and to provide impedance matching over a frequency range of (0.5 to 18) GHz. The narrow conductor slot line is tapered to match the radiation resistance of a dipole element utilized to radiate the electromagnetic energy. The dipole element extends from the balanced narrow conductor slot line on both sides of the dielectric substrate with each wing having an expanded width for accommodating surface current of various distributions over the frequency range. The dipole element also includes an inner flare for radiating energy over the frequency range with the position of the dipole element relative to a ground plane being optimized to minimize radiation reflection.

BRIEF DESCRIPTION OF THE DRAWINGS

FIG. 1 is a top view of an illustrative embodiment of the wideband radiating element of the present invention utilized to radiate electromagnetic energy and to provide wide bandwidth impedance matching.

FIG. 2 is a bottom view of the wideband radiating element of FIG. 1 showing an antenna construction identical to that shown in the top view.

DESCRIPTION OF THE INVENTION

Figure 3:
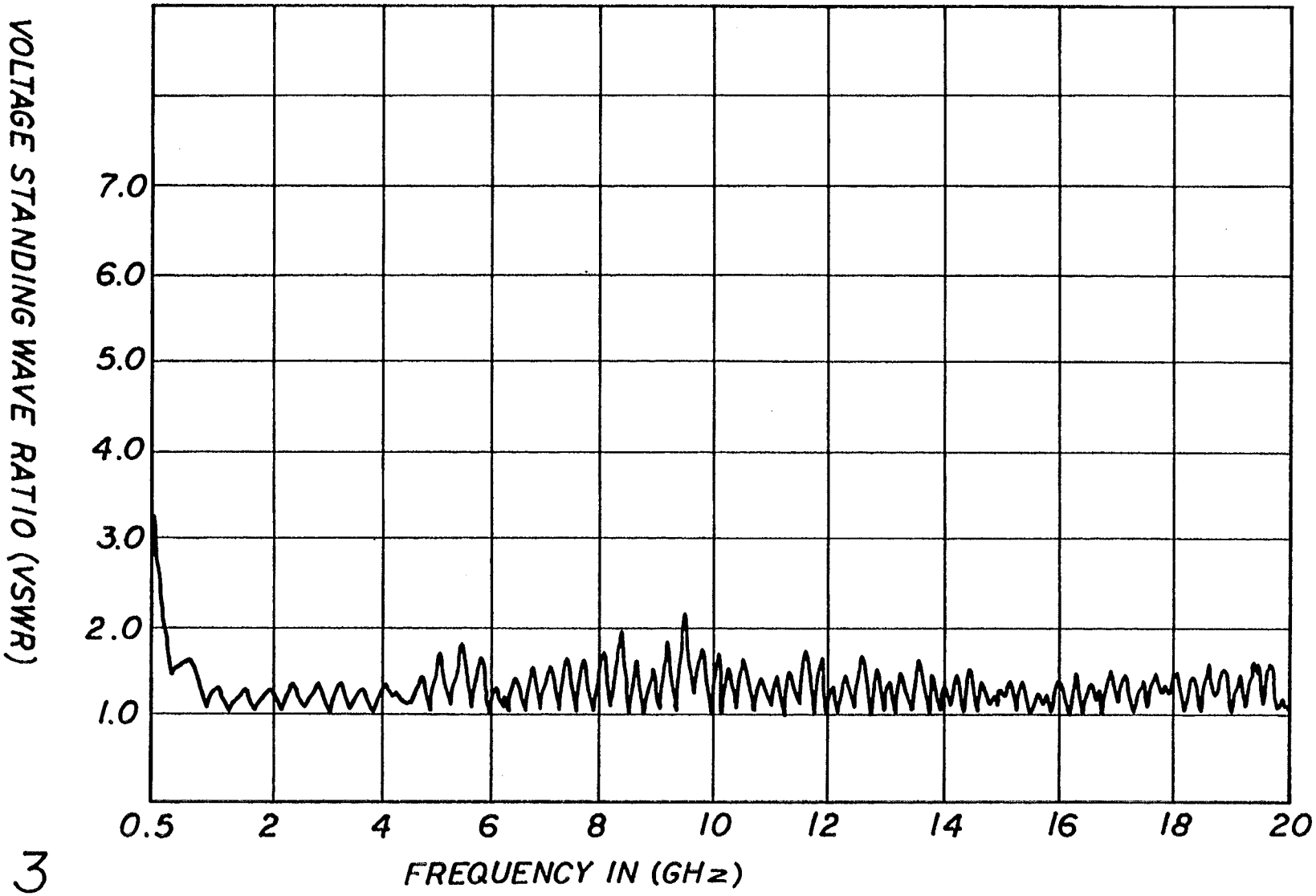
FIG. 3 is a graph of the voltage standing wave ratio versus frequency showing the impedance match of an isolated element from 0.5 to 18.0 GHz.

The invention is a wideband radiating element 100 for use in antenna array applications as shown in FIGS. 1 and 2. The radiating element 100 includes an input mounting block 102 which receives electromagnetic radiation, such as microwaves, from a source 104 via a coaxial cable 106. The input mounting block 102 is physically attached to top and bottom planar surfaces 108 and 110 of a dielectric substrate 112. The radiating element 100 also includes a balanced feed line comprised of the combination of the coaxial cable 106 and the input mounting block 102, an impedance transition section comprised of a pair of flattened conductors 114 and 116, and a pair of tapered dipole wings 118 and 120 for wideband radiation. A narrow conductor slot line 122 is formed by the pair of flattened conductors 114 and 116. The radiating element 100 comprising the flattened conductors 114 and 116 and the pair of tapered dipole wings 118 and 120 is symmetrically printed on both the top and bottom planar surfaces 108 and 110, respectively. This construction is distinguishable from that of the conventional slot line which includes a ground plane on both sides of the substrate with a single slit cut into the middle of the ground plane on one side of the substrate.

The input impedance of the radiating element 100 is approximately 50Ω. The balanced feed line enables the slot line 122 to be designed to match the 50Ω input impedance in the following manner. The inner lead of the coaxial conductor 106 is connected to, for example, the first flattened conductor 114 while the outer lead of the coaxial cable 106 is connected to, for example, the second flattened conductor 116. In prior art designs, the second flattened tapered conductor was replaced by a larger solid conductor with a greater surface area and was effectively closer to the outer lead of the coaxial cable than the inner coaxial lead was to the first flattened conductor 114. This design resulted in interference with impedance matching, particularly at low frequencies.

In the present invention, the coaxial conductors (e.g., particularly the outer coaxial conductor) are positioned away from the flattened conductors 114 and 116 and the tapered dipole wings 118 and 120. The separation of the coaxial leads from the components of the radiating element 100 reduces the influence of the outer lead of the coaxial cable 106 on the flattened conductors 114 and 116 and on the tapered dipole wings 118 and 120. The input circuit design of the present invention results in a more balanced structure which enables impedance matching between the input circuit and the slot line 122. Further, the balanced feed line promotes efficient radiation over the bandwidth from the electromagnetic source 104 to free space with minimum energy reflections.

The impedance of the narrow conductor slot line 122 is designed to match the 50Ω input impedance as disclosed in *Slotline Impedance*, IEEE Transactions on Microwave Theory and Techniques by J. J. Lee, Vol. 39, No. 4, p.666, 1991. As described therein, the design parameters are thickness and dielectric constant of the substrate 112, width of the flattened conductors 114 and 116, and the gap of the slot line 122. Known slot line designs ignore the width of the flattened conductor. The narrow conductor width and the resulting impedance thereof describes the effectiveness of this design. The transition between the dipole wings 118 and 120 and the narrow conductor slot line 122 utilizes these design parameters to calculate the taper. The slot line 122 has a Klopfenstein taper to match the radiation resistance (approximately 100Ω in an array environment). This, in effect, ensures that the gap that defines the slot line 122 opens gradually to launch radiation (indicated by numeral 124 in FIGS. 1 and 2) at various frequencies. Further, the fan-out or spread-out region of the dipole wings 118 and 120 is designed to support surface current and depth of a reference ground plane 126 in an array for a wide frequency range.

The impedance transition region is comprised of the first and second flattened conductors 114 and 116. The transition region serves to change the transmission line impedance from the input stage to the radiating region in a smooth fashion. The flattened conductors 114 and 116, which form the narrow conductor slot line 122, are tapered to match the radiation impedance. The radiation impedance forms the transmission line load. The matching of the input impedance to the transition region impedance to the radiation impedance can be accomplished by either increasing the width of the gap of the slot line 122 or by decreasing the width of the flattened conductors 114 and 116 as shown in FIGS. 1–3. By utilizing conductors 114 and 116 that are flattened, the characteristic impedance of the transmission line is simple to calculate using the method described in *Slotline Impedance* by J J. Lee.

The narrow conductor slot line 122 serves as a transmission channel to propagate the microwave energy from the input mounting block 102 to the radiating dipole wings 118 and 120. By opening the gap of the slot line 122 with a gradual taper, lower ranges of frequencies can be accommodated. In general, the use of a conventional thin dipole is only effective with a narrow bandwidth. By incorporating the taper, propagation efficiency is good for a wide range of frequencies.

The pair of tapered radiating dipole wings 118 and 120 include the taper or curve indicated by numeral 124 in FIGS. 1 and 2. It has been found that the taper 124 in combination with the expanding shape of the dipole wings 118 and 120 ensure that the radiating element provides optimum performance. Radiating dipoles of the prior art have often employed a uniform and thin dipole construction. This type of dipole construction provides a well defined spacing between the dipole element and the reference ground plane 126 where the dipole element is orthogonal to the feed line and parallel to the ground plane 126. At certain microwave frequencies (wavelengths), the radiation reflected from the ground plane 126 will cancel forward-going energy. The cancellation occurs because the reflected energy is 180° out-of-phase with the forward-going energy and effectively reduces the radiation efficiency of the dipole.

The expanding shape of the dipole wings 118 and 120 in combination with the taper 124 eliminates the well defined spacing between the dipole wings and the reference ground plane 126. The present invention discloses a diffused ground plane depth which minimizes the probability of forward-going wave cancellation. The taper 124 as shown in the gap of the slot line 122 and the tapered dipole wings 118 and 120 is smooth to avoid a drastic curvature change. This construction ensures that any forward-going wave cancellation is minimal compared to the forward going wave cancellation associated with the uniform dipole construction of the prior art.

A graph which illustrates the impedance match of an isolated radiating element over the bandwidth of (0.5–18) GHz utilized in combination with the slot line 122 is shown in FIG. 3. The coordinates of the graph of FIG. 3 are Voltage Standing Wave Ratio (VSWR) versus frequency in GHz. The impedance match must exist for the microwave energy to be efficiently transferred from the coaxial cable 106 to the transition region. Note that the average input VSWR has a ratio of approximately 1.5:1 over the entire bandwidth. It is further noted that the input coaxial cable 106, the flattened conductors 114 and 116, and the pair of dipole wings 118 and 120 forming the balanced feed line, the transition section and the radiating section are essentially Transverse Electromagnetic (TEM) structures. Also, the radiation patterns in the orthogonal E- and H-planes of the sample radiating element 100 were measured at different frequencies and found to be well behaved.

Each component of the radiating element 100 is symmetrically printed on both sides of the dielectric substrate 112 resulting in less dispersion. In particular, it is desirable to concentrate the electromagnetic field in a single medium, e.g., either the dielectric substrate 112 or the air. If the electromagnetic field is concentrated in the dielectric medium of the substrate 112, the propagation efficiency is improved.

Figure 4:
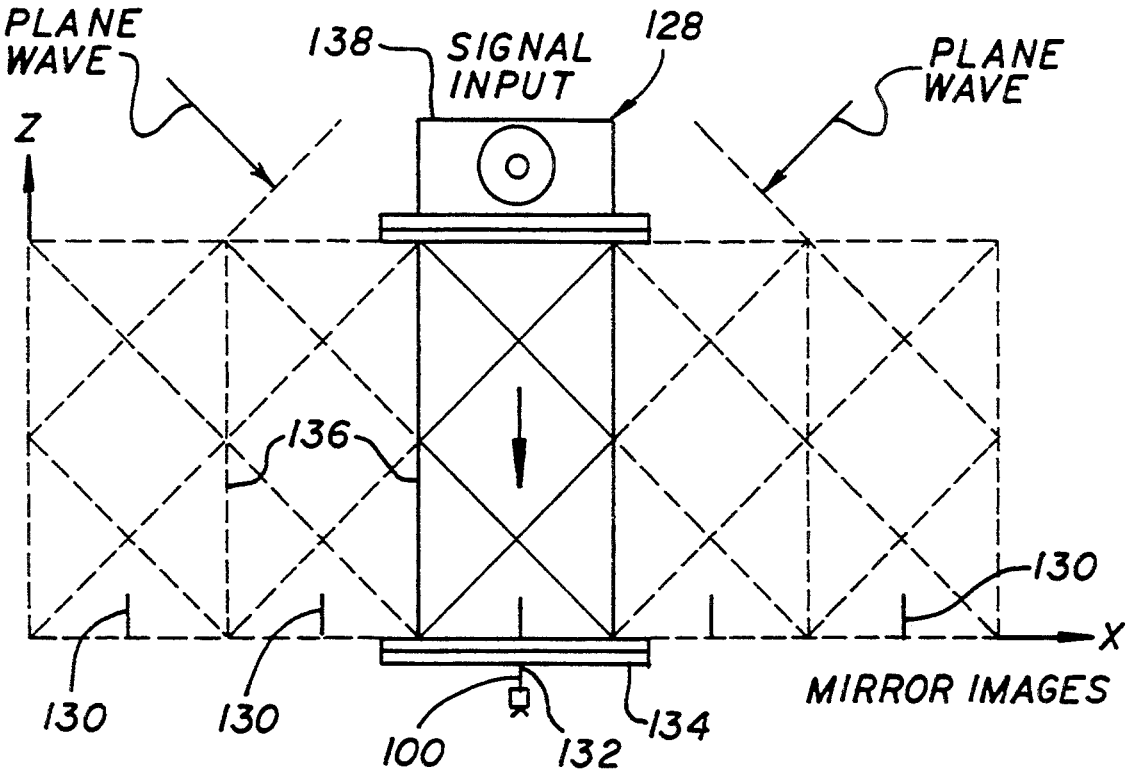
FIG. 4 shows a portion of a rectangular waveguide utilized to simulate an infinite linear array in the H-plane by mirror images.

The wideband radiating element is applicable for use in phased arrays where several of the radiating elements are arranged vertically and horizontally. In an array environment, the radiating element size must be scaled to fit the element spacing of approximately 0.6 wavelengths at the high frequency end of the operating band. To study the mutual coupling effects of the radiating elements 100, a waveguide simulator is utilized to investigate the array performance at certain scan angles as shown in FIG. 4. In particular, a cross-sectional view of the rectangular waveguide designated by numeral 128 is employed to simulate an infinite linear array in the H-plane by mirror images 130.

With the radiating element 100 inserted into the waveguide 128 through a slot 132 on an end plate 134, the depth of the ground plane 126 (shown in FIGS. 1, 2 and **6*b*), radiating element size and the fan-out region of the dipole wings 118 and 120 can be refined for wideband performance in an array. Multiple radiating elements 100 are simulated with respect to a sidewall 136 of the waveguide 128 by utilizing an electrical mirror. Such a design enables the simulation of an infinite linear array. If microwave energy is directed to a signal input 138 of the rectangular waveguide 128, two symmetrically offset plane waves are simulated as shown in FIG. 4. The energy from the two offset plane waves will be absorbed by the radiating element 100** for testing if properly designed.

Figure 5B:
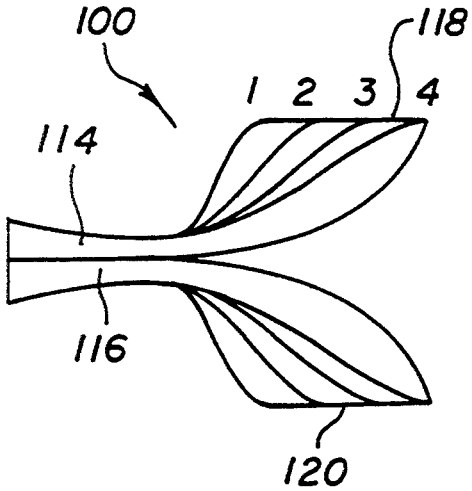
FIG. 5*b* is a top view of the wideband radiating element of FIG. 1 showing the various dipole sizes corresponding to the curves of FIG. 5*a*.
Figure 5A:
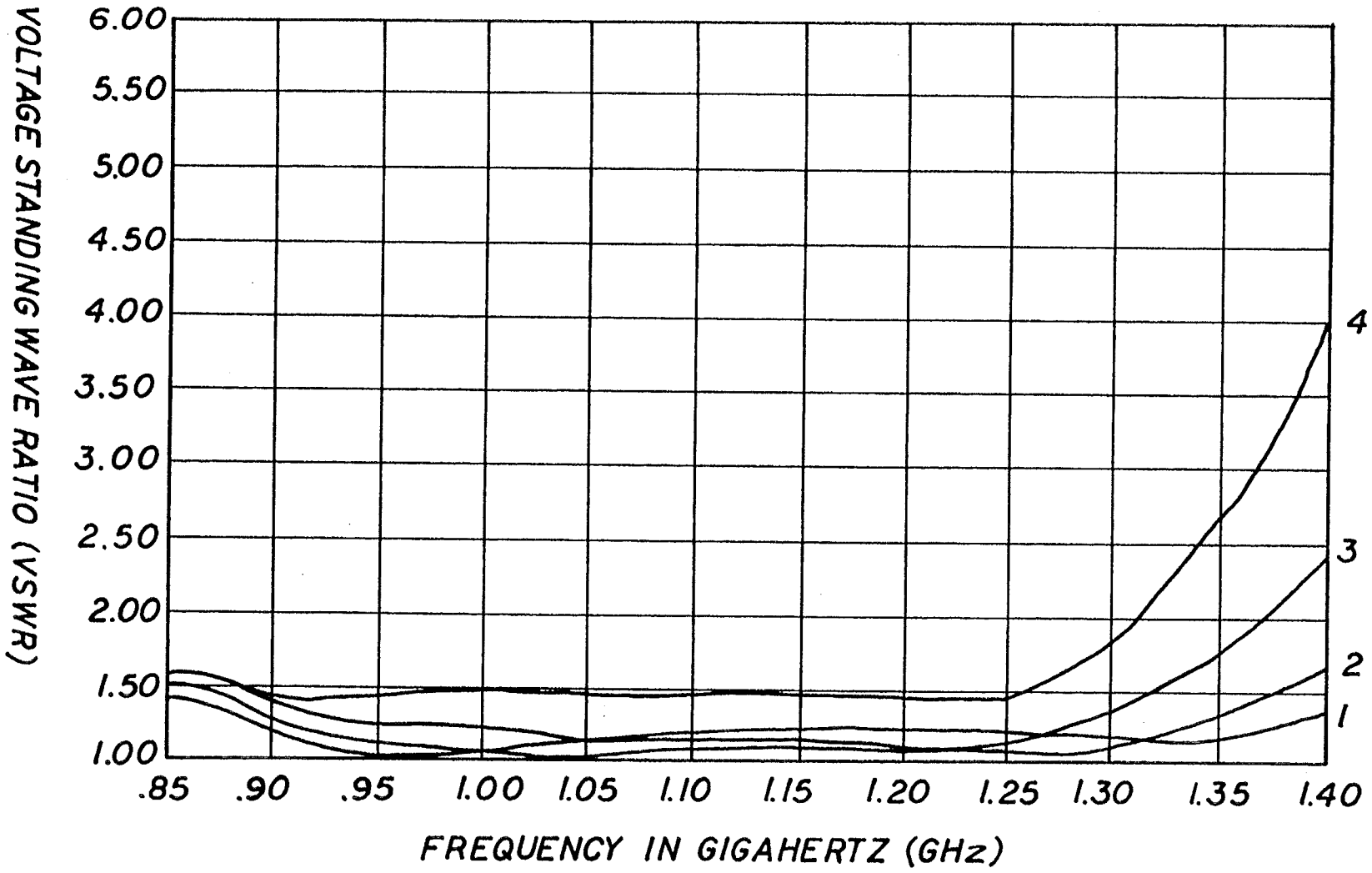
FIG. 5*a* is a graph of the voltage standing wave ratio versus frequency (GHz) showing a plurality of impedance matching curves as a function of various dipole sizes over a 50% bandwidth.

FIG. **5*a* shows the impedance match as a function of the dipole size over a 50% bandwidth (850–1400) MHz. The coordinates of FIG. 5*a* are VSWR vs. frequency (GHz). Four designs (1–4) of the fan-out region of the dipole wings 118 and 120 are shown in FIG. 5*b*. The four designs (1–4) were each tested in the rectangular waveguide simulator 128. Of the four curves (1–4) shown in FIG. 5*a*, curve #1 represents the best dipole design because the VSWR parameter reading is the lowest. This indicates that the energy reflection would be the lowest and thus most favorable. Therefore, design #1 of the dipole wings 118 and 120 shown in FIG. 5*b* was selected and is consistent with the dipole wings shown in FIGS. 1 and 2**.

The position of the radiating element 100 varies with respect to the ground plane 126. The ground plane 126 is a perfect conducting plate which is orthogonal to the radiating element 100 and serves to reflect energy in the direction opposite to the forward-going direction. The position of the ground plane 126 with respect to the radiating element 100, i.e., the ground plane depth, must be optimized. An optimized ground plane depth improves the radiation efficiency of the wideband radiating element 100 of the present invention. Known techniques designed to absorb energy reflected in the direction opposite to the forward going direction generally results in poor efficiency. Furthermore, known techniques that fail to absorb energy reflected in the direction opposite to the forward going direction generally result in narrow bandwidths.

Figure 6B:
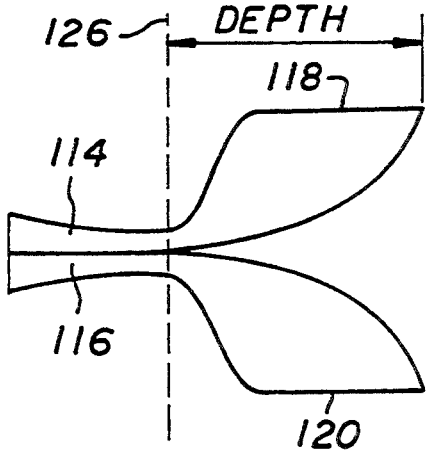
FIG. 6*b* is a top view of the wideband radiating element of FIG. 1 showing the size of the dipole optimized relative to the position of the ground plane.
Figure 6A:
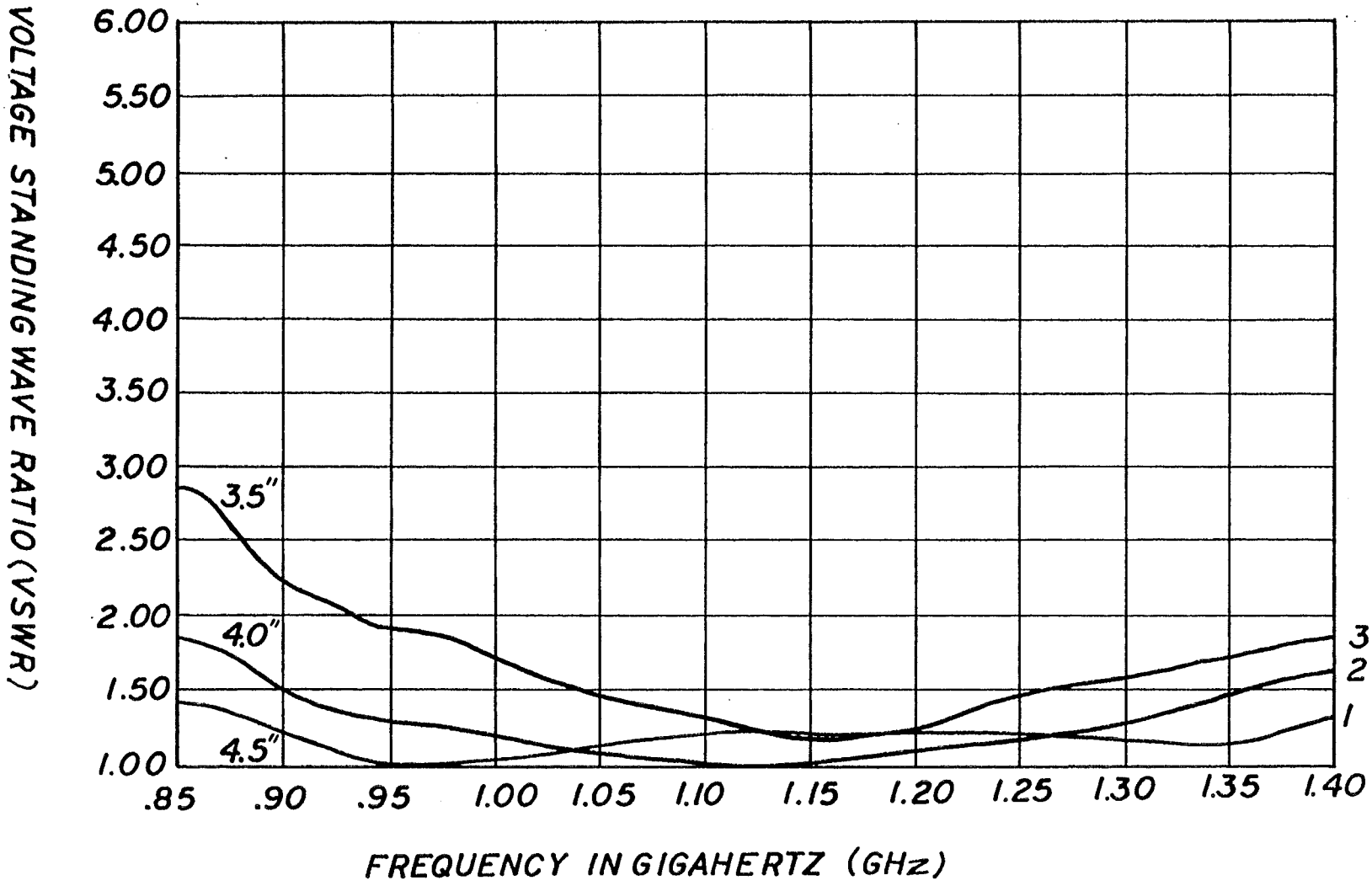
FIG. 6*a* is a graph of the voltage standing wave ratio versus frequency (GHz) showing a plurality of impedance matching curves as a function of ground plane depth.

FIG. **6*a* shows the impedance match as a function of the depth of the ground plane 126**. The coordinates of FIG. 6*a* are VSWR vs. frequency (GHz). The depth of the ground plane 126 shown in FIG. 6*b* is varied by moving the radiating element 100 until the depth resulting in the minimum input energy reflection is determined. Three curves are shown in FIG. 6*a* indicating three different ground plane depth adjustments in FIG. 6*b*. Curve #1 in FIG. 6*a* is selected as best since it exhibits the lowest energy reflection leading to the highest propagation efficiency. Thus, the ground plane 126 shown in FIG. 6*b* is adjusted in accordance with curve #1 shown in FIG. 6*a*.

The principles and construction disclosed in the wideband radiating element 100 of the present invention are equally applicable to circular polarization applications. For circular polarization, two radiating elements 100 can be interleaved orthogonally and fed by a 90° hybrid having two output ports feeding the two pairs of dipole wings 118 and 120.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such modifications, applications and embodiments within the scope of the present invention.

Accordingly,

What is claimed is:

1. A wideband radiating element for use in an array comprised of a plurality of such wideband radiating elements, comprising:

a planar substrate having first and second opposing surfaces;

a balanced feed line;

an impedance transition section coupled to said balanced feed line, and comprised of (a) first identically shaped transition section conductors formed opposite each other on said first and second opposing surfaces of said substrate and (b) second identically shaped transition section conductors formed opposite each other on said first and second opposing surfaces of said substrate, said first transition section conductors having first edges that extend from said feed line and said second transition section conductors having second edges adjacent said first edges and extending from said feed line so as to form a slot line between said first transition section conductors and said second transition section conductors, said slot line having a Klopfenstein impedance taper that is determined by the width of the gap of the slot line and the width of said first and second transition section conductors;

a ground plane disposed orthogonally to said slot line; and expanded shape dipole wings coupled to said impedance transition section and formed on said substrate, said dipole wings comprised of (a) first identically shaped dipole conductors formed opposite each other on said first and second opposing surfaces of said substrate and coupled to said first transition section conductors, and (b) second identically shaped dipole conductors formed opposite each other on said first and second opposing surfaces of said substrate and coupled to said second transition section conductors, said first dipole conductors having first edges that extend from said transition section conductors and said second dipole conductors having second edges adjacent said first edges and extending from said second transition section conductors so as to form a gap between said first dipole conductors and said second dipole conductors, said gap increasing with distance from said first and second transition section conductors, said first and second dipole conductors having a lateral extent orthogonal to said slot line that is greater than a lateral extent of said transition section;

wherein said Klopfenstein impedance taper matches the impedance of said balanced feed line to the radiation impedance of said dipole wings in the array over a wide range of frequencies.

2. The wide band radiating element of claim 1 wherein the width of said slot line gap increases with distance from said balanced feed line and wherein the widths of said first and second transition section conductors decrease with distance from said balanced feed line.

3. The wide band radiating element of claim 1 wherein said balanced feed line comprises a mounting block and a coaxial cable.

4. The wide band radiating element of claim 1 wherein said ground plane is located relative to said dipole wings so as to optimize radiation efficiency.

* * * * *